US008408743B1

(12) United States Patent
Chen et al.

(10) Patent No.: US 8,408,743 B1
(45) Date of Patent: Apr. 2, 2013

(54) LED MODULE WITH FIXING DEVICE

(75) Inventors: Te-Sheng Chen, Miao-Li (TW); Sung-Hsiang Yang, Miao-Li (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 8 days.

(21) Appl. No.: 13/325,003

(22) Filed: Dec. 13, 2011

(51) Int. Cl.
*F21V 33/00* (2006.01)

(52) U.S. Cl. ..... 362/249.02; 362/396; 362/800

(58) Field of Classification Search ..... 362/396, 362/427, 382, 249.02, 249.1, 249.11, 800
See application file for complete search history.

(56) References Cited

U.S. PATENT DOCUMENTS

| | | | | |
|---|---|---|---|---|
| 5,103,382 | A * | 4/1992 | Kondo et al. | 362/503 |
| 5,309,331 | A * | 5/1994 | Anzai et al. | 362/503 |
| 7,648,251 | B2 * | 1/2010 | Whitehouse et al. | 362/223 |
| 8,246,206 | B2 * | 8/2012 | Hung et al. | 362/249.11 |

* cited by examiner

*Primary Examiner* — Laura Tso
(74) *Attorney, Agent, or Firm* — Altis Law Group, Inc.

(57) ABSTRACT

An LED module includes a light bar and a fixing device. The light bar includes a supporting plate and a circuit board mounted on the supporting plate. The circuit board has a plurality of light emitting diodes thereon. The supporting plate includes a first tongue and a second tongue respectively extending from two opposite ends thereof. The fixing device includes a substrate to support the light bar, a fastening piece and a tenon fixing respectively the two ends of the light bar on the substrate. The fastening piece includes a seat fixed on the substrate and a locking arm connecting to the seat. The first tongue of the light bar is embedded in the tenon, and the second tongue of the light bar is received in a space defined between the seat and the locking arm.

13 Claims, 5 Drawing Sheets

LED MODULE WITH FIXING DEVICE

BACKGROUND

1. Technical Field

The disclosure relates to an LED module, and particularly to an LED module with a fixing device for facilitating assembly/disassembly of the LED module.

2. Description of the Related Art

LEDs' many advantages, such as high luminosity, low operational voltage, low power consumption, compatibility with integrated circuits, easy driving, long term reliability, and environmental friendliness have promoted their wide use as a light source. Now, LEDs are commonly applied in environmental lighting.

Commonly, an LED module includes an LED light bar fixed on a substrate by screwing or pasting. However, it is time-consuming to disassemble the LED light bar from the LED module for a required repair or maintenance.

Therefore, it is desirable to provide an LED module with a fixing device which can overcome the described limitations.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present LED module. Moreover, in the drawings, like reference numerals designate corresponding parts throughout the views.

DETAILED DESCRIPTION

Embodiments of an LED module as disclosed are described in detail here with reference to the drawings.

Figure 1:
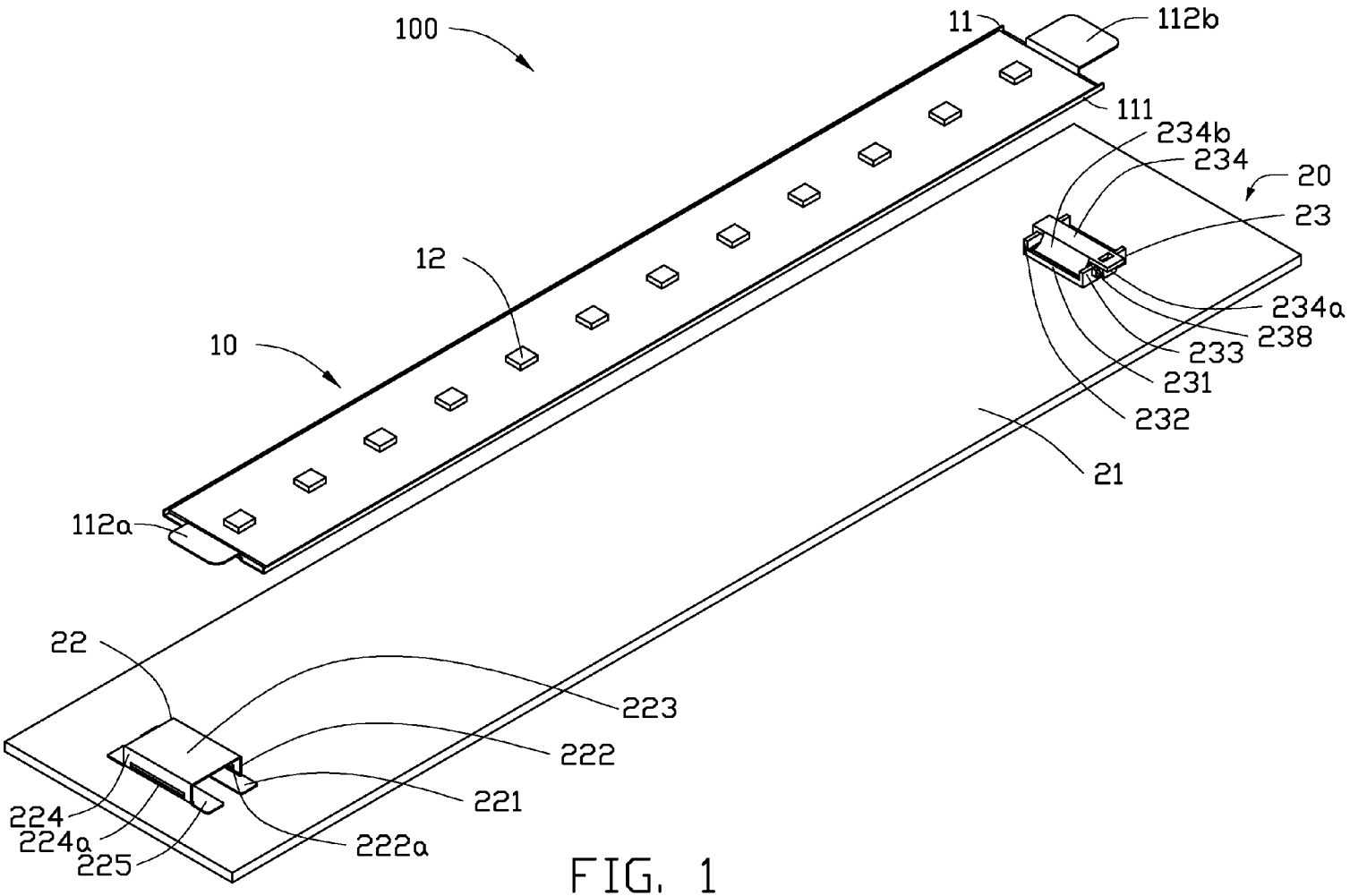
FIG. 1 is an isometric, exploded view of an LED module in accordance with an embodiment of the present disclosure.

Referring to FIG. 1, an LED module 100 according to an embodiment is shown, which includes a light bar 10 and a fixing device 20.

Figure 2:
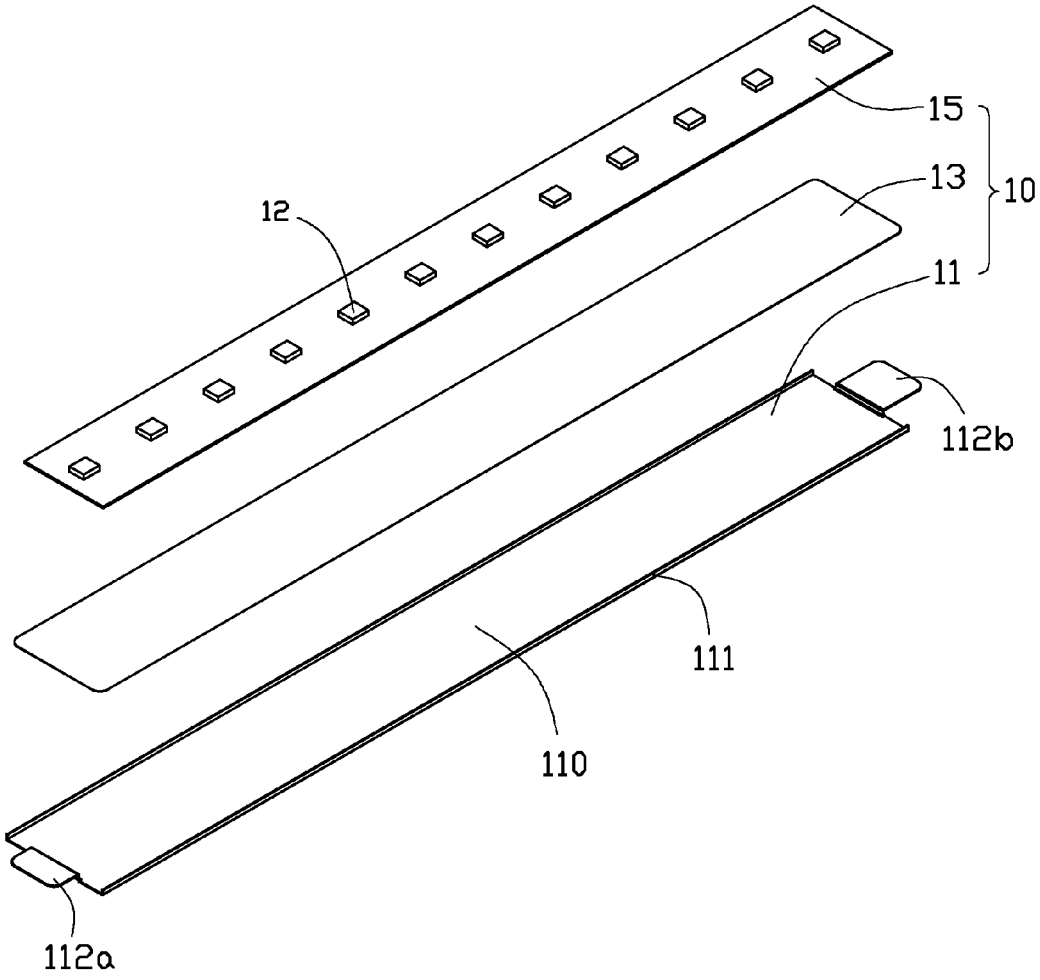
FIG. 2 is an exploded view of a light bar of the LED module of FIG. 1.

Referring to FIG. 2, the light bar 10 includes a circuit board 15, an electrically insulating and heat conductive board 13, and a metallic supporting plate 11. Each of the circuit board 15, the heat conductive board 13 and the supporting plate 11 has a shape of an elongated, rectangular strip. The board 13 is sandwiched between the circuit board 15 and the supporting plate 11 for electrically insulating the circuit board 15 from the supporting plate 11 and at the same time transferring heat of the circuit board 15 to the supporting plate 11 for further dissipation.

A plurality of light emitting diodes 12 is mounted on and electrically connected to the circuit board 15. The supporting plate 11 includes an elongated strip-shaped main body 110, and a first tongue 112*a* and a second tongue 112*b* respectively extending from two opposite ends of the main body 110. Each of the first tongue 112*a* and the second tongue 112*b* is a tab protruding upwardly from the main body 110 first and then horizontally outward. The supporting plate 11 includes two flanges 111 extending upwardly from two lateral sides of the main body 110. When assembled, the heat conductive board 13 and the circuit board 15 are disposed on and overlap the main body 110, with the first tongue 112*a*, the second tongue 112*b* and the flanges 111 surrounding the heat conductive board 13 and the circuit board 15.

Referring to FIG. 1 again, the fixing device 20 includes a substrate 21, a tenon 22 and a fastening piece 23. The substrate 21 is elongated and rectangular. A size of the substrate is larger than that of the light bar 10. The tenon 22 and the fastening piece 23 are spaced from each other and mounted on opposite ends of the substrate 21, respectively. Two ends of the light bar 10 can be respectively fixed by the tenon 22 and the fastening piece 23 on the substrate 21.

Figure 3:
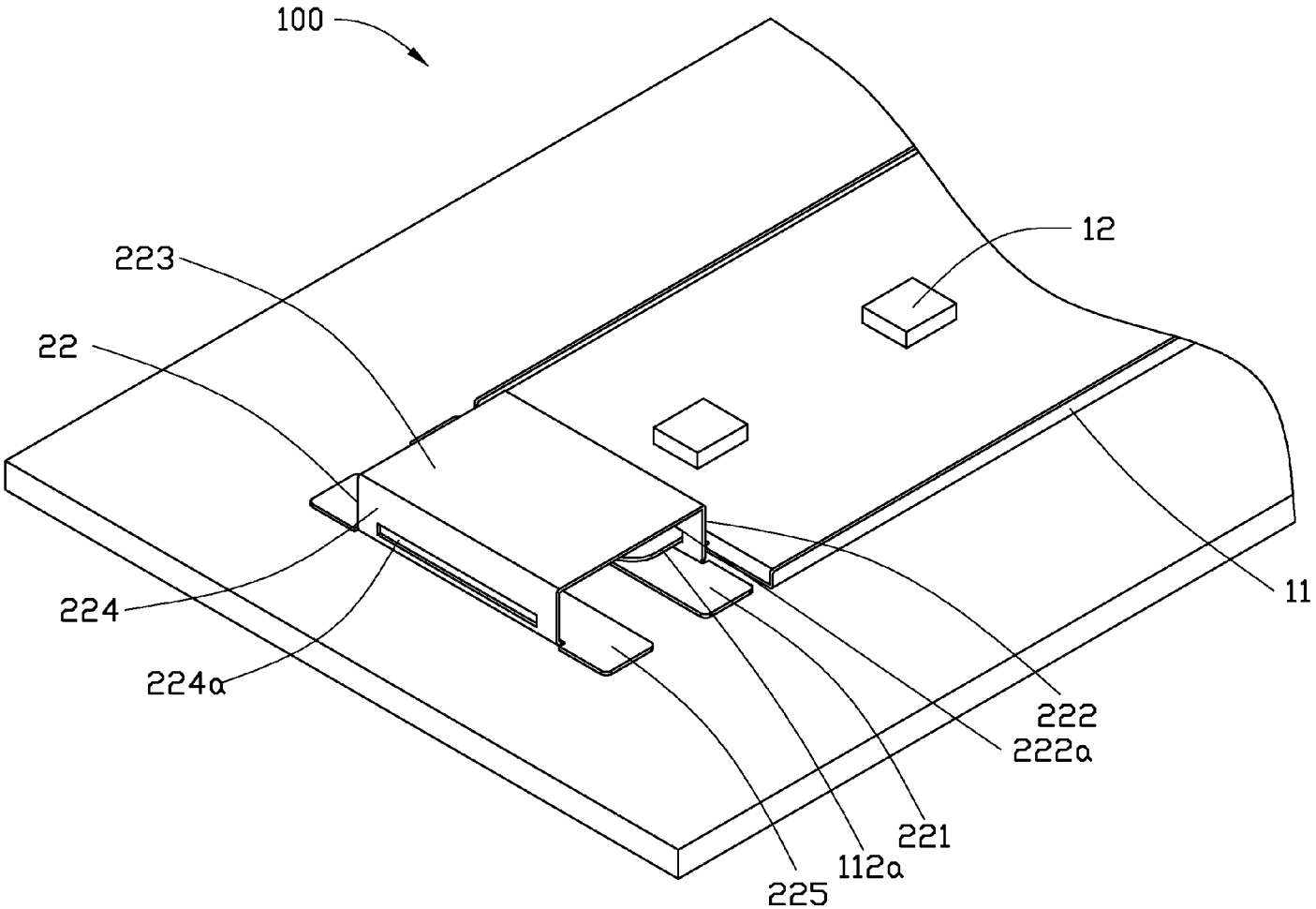
FIG. 3 is an assembled and enlarged view of an end portion of the LED module of FIG. 1.

Referring to FIG. 3, the tenon 22 includes a first bottom plate 221, a first lateral plate 222, a top plate 223, a second lateral plate 224, and a second bottom plate 225. The first bottom plate 221 and the second bottom plate 225 are spaced from each other and mounted on the substrate 21. The first lateral plate 222 extends upwardly from an outer edge of the first bottom plate 221. The second lateral plate 224 extends upwardly from an outer edge of the second bottom plate 224. In this embodiment, the first and second bottom plates 221, 225 and the first and second lateral plates 222, 224 all are perpendicular to a longitudinal direction of the substrate 21. The top plate 223 interconnects tops of the first lateral plate 222 and the second lateral plate 224. Thus, the first lateral plate 222, the second lateral plate 224 and the top plate 223 form an inverted U-shape configuration, as viewed from FIG. 1. The first lateral plate 222 defines a longitudinal hole 222*a* to receive the first tongue 112*a* of the supporting plate 11. The longitudinal hole 222*a* is parallel to first bottom plate 221. The second lateral plate 224 defines a longitudinal hole 224*a* corresponding to the longitudinal hole 222*a*.

Figure 4:
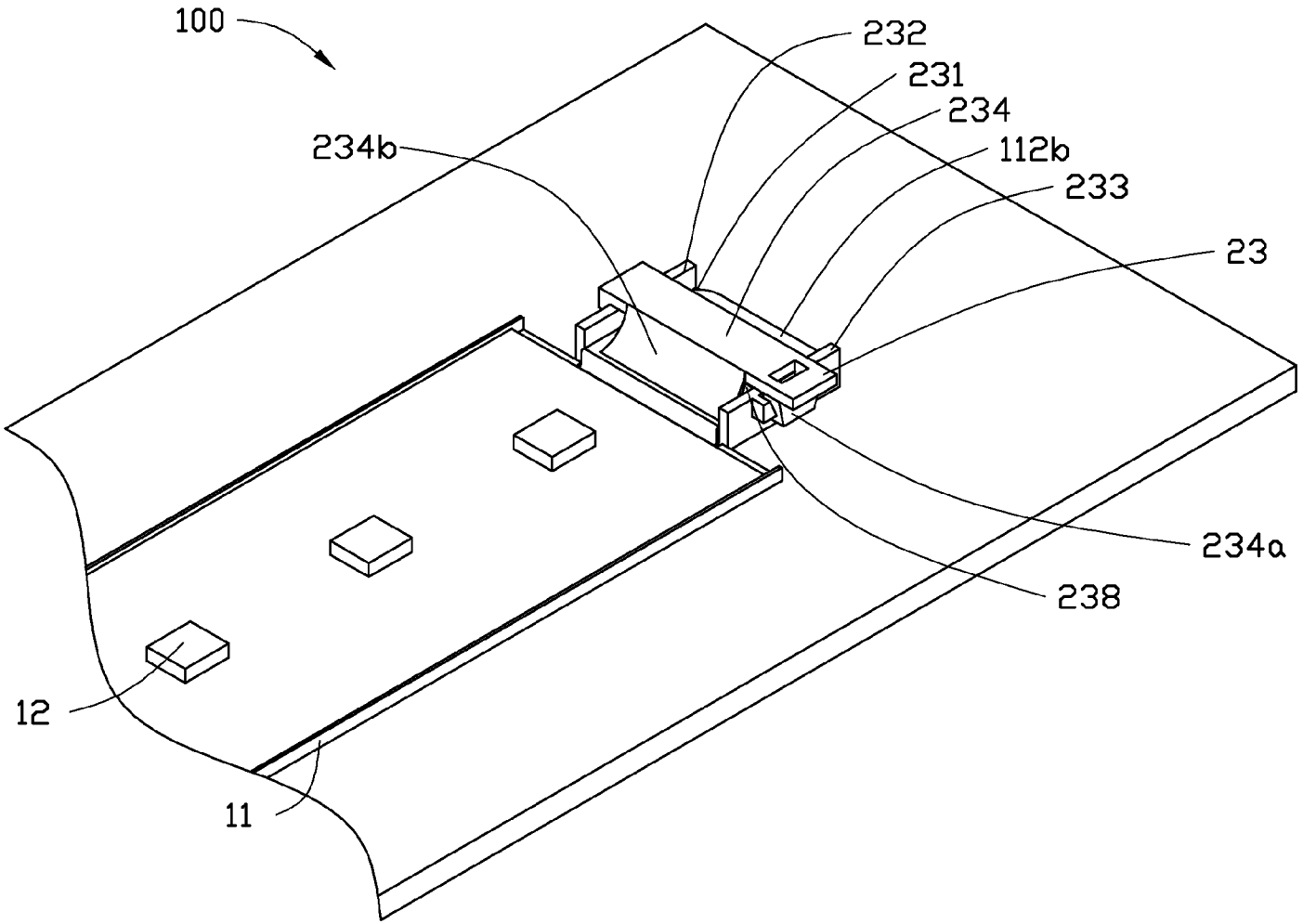
FIG. 4 is a view similar to FIG. 3 but showing the other end portion of the LED module of FIG. 1.
Figure 5:
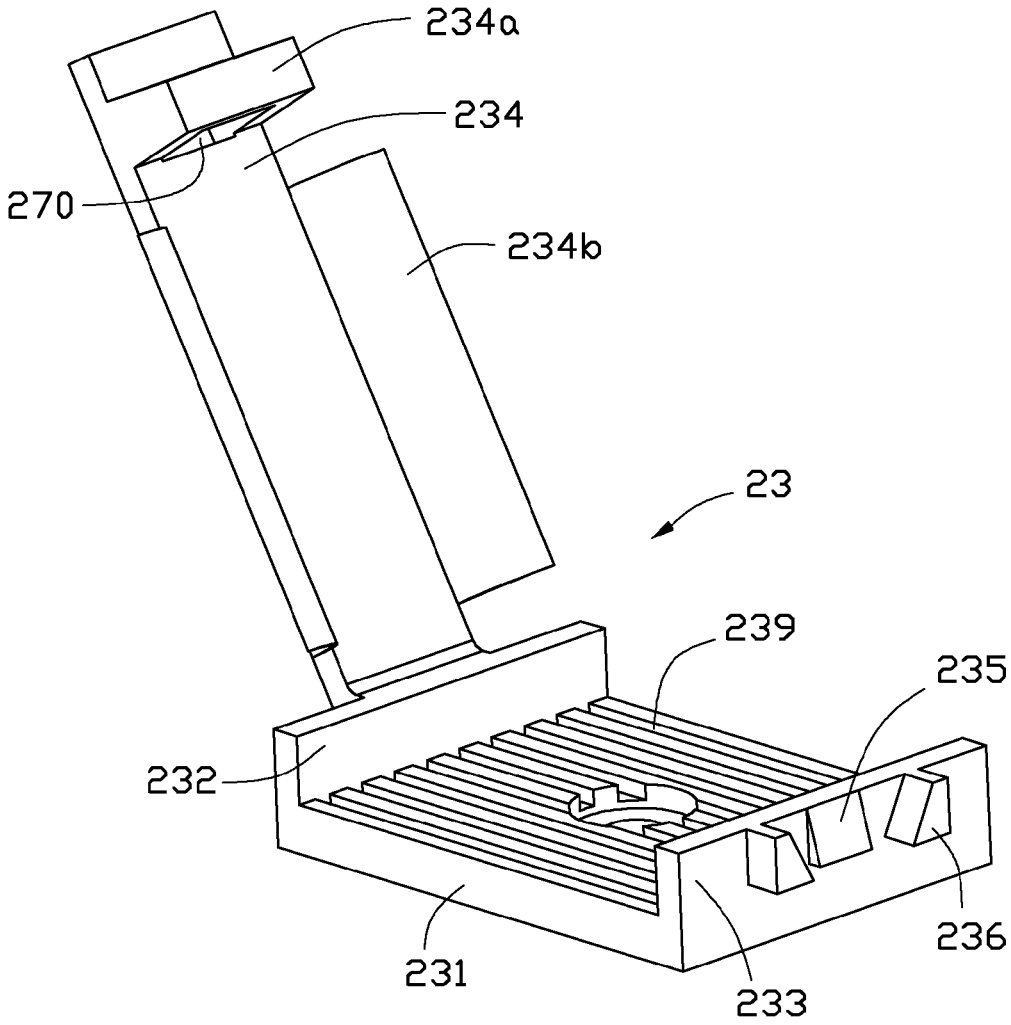
FIG. 5 is an isometric view of a fastening piece of the LED module of FIG. 1 in an opened position.

Referring to FIGS. 4-5, the fastening piece 23 includes a seat 231, a connection wall 232 and a fixing wall 233 extending upwardly from two sides of the seat 231, and a locking arm 234 pivotally engaged with the connection wall 232. The seat 231, the connection wall 232 and the fixing wall 233 cooperatively define a receiving room 238 to receive the second tongue 112*b* of the light bar 10 therein. The fastening piece 23 formed as a single piece is made of plastic material in this embodiment.

The seat 231 forms a plurality of ribs 239 on an upper surface thereof to increase the friction force between the seat 231 and the second tongue 112*b* of the light bar 10. The connection wall 232 and fixing wall 233 extend up from opposite lateral sides of the seat 231, and are parallel to the longitudinal direction of the substrate 21. A first protrusion 235 is formed on an outside of the fixing wall 233, and two second protrusions 236 are formed on the outside of the fixing wall 233 and located at opposite sides of the first protrusion 235. The first protrusion 235 is a wedge. A thickness of the first protrusion 235 gradually increases from a top of the fixing wall 233 to a middle of the fixing wall 233.

One end of the locking arm 234 connected to the connecting wall 232 is rotatable. The other end of the locking arm has a hook portion 234*a* extending downward therefrom. A receiving slot 270 is defined in the hook portion 234*a* for receiving the first protrusion 235. Two opposite lateral sides of the locking arm 234 each is formed with a curved contact element 234*b* protruding toward the seat 231, for tightly pressing the second tongue 112*b* on the seat 231.

When the light bar 10 is arranged on the substrate 21 of the fixing device 20 for assembly, the first protrusion 235 is disengaged from the receiving slot 270, and the locking arm 234 is rotated upwardly to open the top side of the receiving room 238. Then, the first tongue 112*a* of the light bar 10 is inserted in the longitudinal hole 222*a* of the first lateral plate 222 of the tenon 22, and the second tongue 112*b* of the light bar 10 is received in the receiving room 238 of the fastening piece 23. Thereafter, of the locking arm 234 is rotated downwardly to cause the fastening piece 23 to clamp the second tongue 112*b*, wherein the hook portion 234*a* and the first protrusion 235 are fastened together. The contact element 234*b* of the locking arm 234 presses the second tongue 112*b* of the light bar 10 which is fixed in position accordingly. When the light bar 10 needs to be replaced, the first protrusion 235 can be disengaged from the receiving slot 270 first, and then the locking arm 234 is rotated upwardly to open the top side of the receiving room 238, thereby, the light bar 10 can be drawn out from the fixing device 20 easily.

In this embodiment, the two ends of the light bar 10 are respectively fixed by the tenon 22 and the fastening piece 23 of the fixing device 20. Since the space of the fastening piece 23 receiving the end of the light bar 10 can be opened/closed by rotating the locking arm 234, user could easily assemble and disassemble the LED module 100. In alternative embodiment, the substrate 21 can be designed at each end thereof with one fastening piece 23, further facilitating assembly/disassembly of the light bar 10 to the substrate 21.

It is to be understood, however, that even though numerous characteristics and advantages of certain embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED module, comprising:

a light bar comprising a supporting plate, a circuit board mounted on the supporting plate, and a plurality of light emitting diodes on the circuit board, the supporting plate comprising a first tongue and a second tongue respectively extending from two opposite ends thereof; and a fixing device comprising a substrate to support the light bar, a fastening piece and a tenon fixing respectively two ends of the light bar on the substrate, the fastening piece comprising a seat fixed on the substrate and a locking arm pivotally connecting to the seat, the first tongue of the light bar being embedded in the tenon, the second tongue of the light bar being received in a space defined between the seat and the locking arm, the locking arm pressing the second tongue toward the seat.

2. The LED module of claim 1, wherein the tenon defines a longitudinal hole to receive the first tongue of the light bar.

3. The LED module of claim 2, wherein the tenon comprises a first lateral plate, a second lateral plate, and a top plate interconnecting the first lateral plate and the second lateral plate, and the longitudinal hole is defined at the first lateral plate.

4. The LED module of claim 3, wherein the tenon comprises a first bottom plate connecting the first lateral plate, and a second bottom plate connecting the second lateral plate, the first bottom plate and the second bottom plate being mounted on the substrate.

5. The LED module of claim 1, further comprising an electrically insulating and heat conductive board, wherein the supporting plate is made of metal, and the electrically insulating and heat conductive board is arranged between the supporting plate and the circuit board.

6. The LED module of claim 1, wherein the fastening piece is formed as a single piece and made of plastic material.

7. The LED module of claim 1, wherein two opposite lateral sides of the locking arm each is formed with a curved contact element extending toward the seat, the curved contact element tightly pressing the second tongue of the light bar on the seat.

8. The LED module of claim 1, wherein the seat of the fastening piece forms a plurality of ribs on an upper surface thereof to increase a friction force between the seat and the second tongue.

9. An LED module, comprising:

a light bar comprising a supporting plate and a circuit board on the supporting plate, the circuit board having a plurality of light emitting diodes thereon, the supporting plate comprising two tongues respectively extending from two opposite ends thereof; and a fixing device comprising a substrate to support the light bar, a first fastening piece fixing one tongue of the light bar one the substrate and a second fastening piece fixing the other tongue of the light bar on the substrate, the first fastening piece comprising a seat fixed on the substrate and a locking arm, one end of the locking arm being pivotally connecting to the seat and being rotatable, the other end of the locking arm being detachably connected to the seat, the one tongue of the light bar being received in a space between the locking arm and the seat.

10. The LED module of claim 9, further comprising an electrically insulating and heat conductive board, wherein the supporting plate is made of metal, and the electrically insulating and heat conductive board is arranged between the supporting plate and the circuit board.

11. The LED module of claim 9, wherein each of the fastening pieces is formed as a single piece and made of plastic material.

12. The LED module of claim 9, wherein opposite lateral sides of the locking arm each is formed with a curved contact element tightly pressing the one tongue of the light bar on the seat.

13. The LED module of claim 9, wherein the seat of the first fastening piece forms a plurality of ribs on an upper surface thereof to increase the friction force between the seat and the one tongue.

* * * * *